US005363906A

United States Patent [19]

Borowy

[11] Patent Number: 5,363,906

[45] Date of Patent: Nov. 15, 1994

[54] AIR HEATER SEALS

[76] Inventor: William J. Borowy, 3514 Traylor Dr., Richmond, Va. 23235

[21] Appl. No.: 915,610

[22] Filed: Jul. 21, 1992

Related U.S. Application Data

[62] Division of Ser. No. 522,136, May 11, 1990, Pat. No. 5,137,078.

[51] Int. Cl.[5] ..... F28D 19/00

[52] U.S. Cl. ..... 165/9; 277/53

[58] Field of Search ..... 165/9; 277/53

[56] References Cited

U.S. PATENT DOCUMENTS

| | | | |
|---|---|---|---|
| Re. 31,403 | 10/1983 | Burrous . | |
| 885,032 | 4/1908 | Ferranti . | |
| 2,681,208 | 6/1954 | Boestad et al. . | |
| 3,745,053 | 5/1972 | Johnson . | |
| 4,149,587 | 4/1979 | Stockman . | |
| 4,159,828 | 7/1979 | Ostling . | |
| 4,214,930 | 6/1980 | Burrous . | |
| 4,398,508 | 8/1983 | Moon . | |
| 4,415,309 | 11/1983 | Atterbury . | |
| 4,651,809 | 3/1987 | Gollnick . | |
| 4,673,026 | 6/1987 | Hagar . | |
| 4,825,936 | 5/1989 | Hoagland et al. | 165/9 |
| 4,836,412 | 6/1989 | Webber . | |

FOREIGN PATENT DOCUMENTS

| | | | |
|---|---|---|---|
| 653370 | 12/1962 | Canada | 165/9 |
| 250172 | 11/1925 | United Kingdom | 165/9 |
| 1479587 | 7/1977 | United Kingdom | 165/9 |
| 2119037 | 11/1983 | United Kingdom | 165/9 |

OTHER PUBLICATIONS

Mac Duff, Clark, Jan. 1976 "Ljungstrom Air Preheater Design and Operation", Combustion.

"Steam Generator Auxillaries", Combustion.

"Eagleair, Inc.".

"Eagleair Rotary Air Heater Seals".

"Eagleair Drawing No. EP-002", Oct. 1983.

*Primary Examiner*—Albert W. Davis, Jr.

*Attorney, Agent, or Firm*—Cushman, Darby & Cushman

[57] ABSTRACT

The present invention is an arrangement of seals for an air heater used to preheat the intake air of a combustion process. Flexible seals and torsion bars are utilized in order to allow the flexible seals to adjust angle and properly fill the void space to be sealed. Also, a combination of sealing elements are used on the circular seal of the present invention in order to create a tortuous path for gas flow through the seals. The present invention offers many advantages over seals found in the prior art including improved wearability and low maintenance.

11 Claims, 9 Drawing Sheets

AIR HEATER SEALS

This is a division of application Ser. No. 07/522,136, filed May 11, 1990 now U.S. Pat. No. 5,137,078.

BACKGROUND OF THE INVENTION

1. Field of the Invention

This invention relates to a sealing arrangement for air heaters, and more particularly to an improvement to seals used on air heaters that cool the exhaust gasses and preheat the combustion air of organic fuel boilers. The present invention provides a more reliable seal that is less susceptible to wear.

2. Description of The Related Art

Air heaters are commonly used on boilers and furnaces to cool the resulting exhaust gasses and to preheat intake air by transferring energy from the exhaust gasses to the intake air. The raised temperature of the intake air supplied to the boiler allows combustion to be more complete and efficient. Since the heat contained in the exhaust gasses would otherwise be wasted, the use of this heat, to preheat the combustion intake, increases efficiency of the combustion process thus saving energy.

Before discussing the purpose and function of air heater seals it is important to understand the construction and function of a typical air heater. The air heater consists of a rotor in a housing. The rotor is of a cylindrical shape, several feet in diameter and several feet in height. Vertical dividing plates divide the rotor into equal sized pie-shaped sections, these plates extend along the full radius, and height, of the rotor. Within each section of the rotor is a heat exchanging element, consisting of an arrangement of materials of high thermal conductivity, usually metal.

The housing surrounding the rotor includes sector plates which close portions of the top and bottom of the housing and divide it into halves. One half of the housing has an inlet for cool air at the bottom and an outlet for heated air at the top. The other half of the housing has an outlet for cooled flue gas at the bottom and an inlet for hot exhaust gasses at the top. In operation, the rotor is rotated about its central axis causing the heat exchanging elements to be placed, alternately, into the flow path of the flue gasses and the flow path of the air. The arrangement resembles a revolving door with entrances and exits at the top and bottom instead of the sides.

When the heat exchanging elements are placed into the flow path of the hot exhaust gasses from the boiler, the element absorbs some of the energy of the gasses, cooling the gasses and heating the element. When rotation of the rotor then places this hot element into the path of the boiler inlet air supply the air is heated and the element is cooled. The resulting heated air may also be used for drying pulverized fuel or for other applications. This cycle is repeated for each heat exchanging element while the air heater is in operation. The result is that energy normally lost in heat of the exhaust gasses is recycled.

In order for the air heater cycle to be efficient, each section containing a heat exchanging element must be isolated from all other sections in order to prohibit gas leakage around the cool and hot elements. Further losses, due to leakage from the pressurized air side to the gas side of the air heater, which is typically in a state of relative vacuum, must be limited. For this purpose several styles of flexible seals have been developed that allow the rotor to rotate while somewhat prohibiting undesirable energy exchange, due to convection, between the elements.

The most popular materials used for seals are single or multiple metal leaf elements. These seals are popular because of their flexible characteristics. Since there are large temperature gradients within an air heater, deformation of the rotor and housing will occur. Flexible seals can bend and compensate somewhat for the changing gap between the rotor and the top, bottom and sides of the housing. Deformation also occurs as a result of poor construction tolerances or sagging due to gravity. A known air heater and sealing arrangement are illustrated in FIG. 1. The rotor 50 revolves around rotor post 17 in a direction indicated at D. Rotor 50 consists of rotor shell 8 and several vertical section dividing plates 35 extending radially outward from rotor post 17 to rotor shell 8 thus dividing rotor 50 into several pie shaped sections. A heat exchanging element (not shown) resides in each pie shaped section.

Rotor 50 is surrounded by housing 1 (shown in section) at the perimeter of rotor 50. Attached to housing 1 is connecting flange 10, facilitating connection to the boiler system ductwork (not shown). To prohibit leakage of air between each pie shaped section flexible radial seals 52 are located along the top and bottom edges of section dividing plates 35. Axial seals 54 are attached to the outer surface of rotor shell 8 prohibiting the flow of air between rotor shell 8 and housing 1. Finally, a circular seal 60 (shown in section) made of a thin flexible metal is attached to the top and bottom edges of rotor shell 8 so as to prohibit vertical air flow between rotor shell 8 and housing 1. Circular seal 60 extends around the entire circumference of rotor 50.

It is well known to construct these seals of thin, flexible metal or another solid, temperature resistant material.

The seals must be adjusted to seal when the gaps are the largest. This means that when the gaps are small the seals will be severely bent and forced into a high contact pressure with the rotor or housing. For this reason seals known in the prior art wear relatively quickly, causing replacement, air to gas leakage as great as 20 percent, downtime and great expense.

This problem has been addressed in the design of some more recent air heaters that have incorporated a complex electrical control system and hydraulics to bend the housing into conformation with the rotor as it distorts due to temperature gradients. This type of a system is expensive, and requires maintenance of a complex electro/hydraulic system as well as maintenance of the existing seals.

In addition, it has been known to utilize metal brushes as a seal between moving parts such as is disclosed in U.S. Pat. No. 4,398,508 to Moon et al. The Moon patent is for a seal between a fan and its shroud. This type of seal is designed for a small gap of fixed distance between machine surfaces.

SUMMARY OF THE INVENTION

The present invention is an arrangement of radial, circular and axial seals that can accommodate the varying gap sizes due to thermal gradients in an air heater, are less susceptible to wear, and superior in performance to seals known in the prior art.

The radial seal, and the axial seal, of the present invention are constructed of metal brush, metal leaf, amorphic wire felt, a like material, or a combination of materials. To allow for deformation of the rotor during operation, the seal may be mounted on a torsion bar. This allows the seal to respond to variance in the size of the gap to be sealed without placing undue contact pressure on the seal. In the absence of undue pressure the seal will last longer, i.e., wear will be slower and the possibility of shearing will be lessened. A seal of this type is also able to cover a wider range of gap distances eliminating the need for readjustment if system variables change.

The circular seal of the present invention includes a series of contacting flexible seals (e.g. wirebrush, or amorphic felt) in close proximity to each other with non-contacting leaves therebetween. This combination places a tortuous path between the fluid flow paths and the side of the housing, minimizing air/gas leakage.

Other objects, features and characteristics of the present invention, as well as the methods of operation and function of the related elements of the structure, and the combination of parts and economies of manufacture, will become more apparent upon consideration of the following detailed description and the appended claims with reference to the accompanying drawings all of which form a part of this specification.

BRIEF DESCRIPTION OF THE DRAWINGS

FIG. 4(*b*) is a detail of the portion of the preferred embodiment of FIG. 3 furthest from the center of the air heater rotor;

FIG. 5(*b*) is a detail of the portion of the preferred embodiment of FIG. 3 in the proximity of the outermost multiple bearing pillow block;

FIG. 6(*b*) is section of a seal brush of the present invention constructed of wire brush;

FIG. 6(*c*) is a section of a seal brush of the preferred embodiment with leaf seals on both sides thereof;

FIG. 6(*d*) is a section of a seal of the preferred embodiment constructed of amorphic felt;

FIG. 7(*b*) is a the axial seal and the circular seal of the preferred embodiment in section;

DETAILED DESCRIPTION OF THE PREFERRED EMBODIMENT

Figure 1:
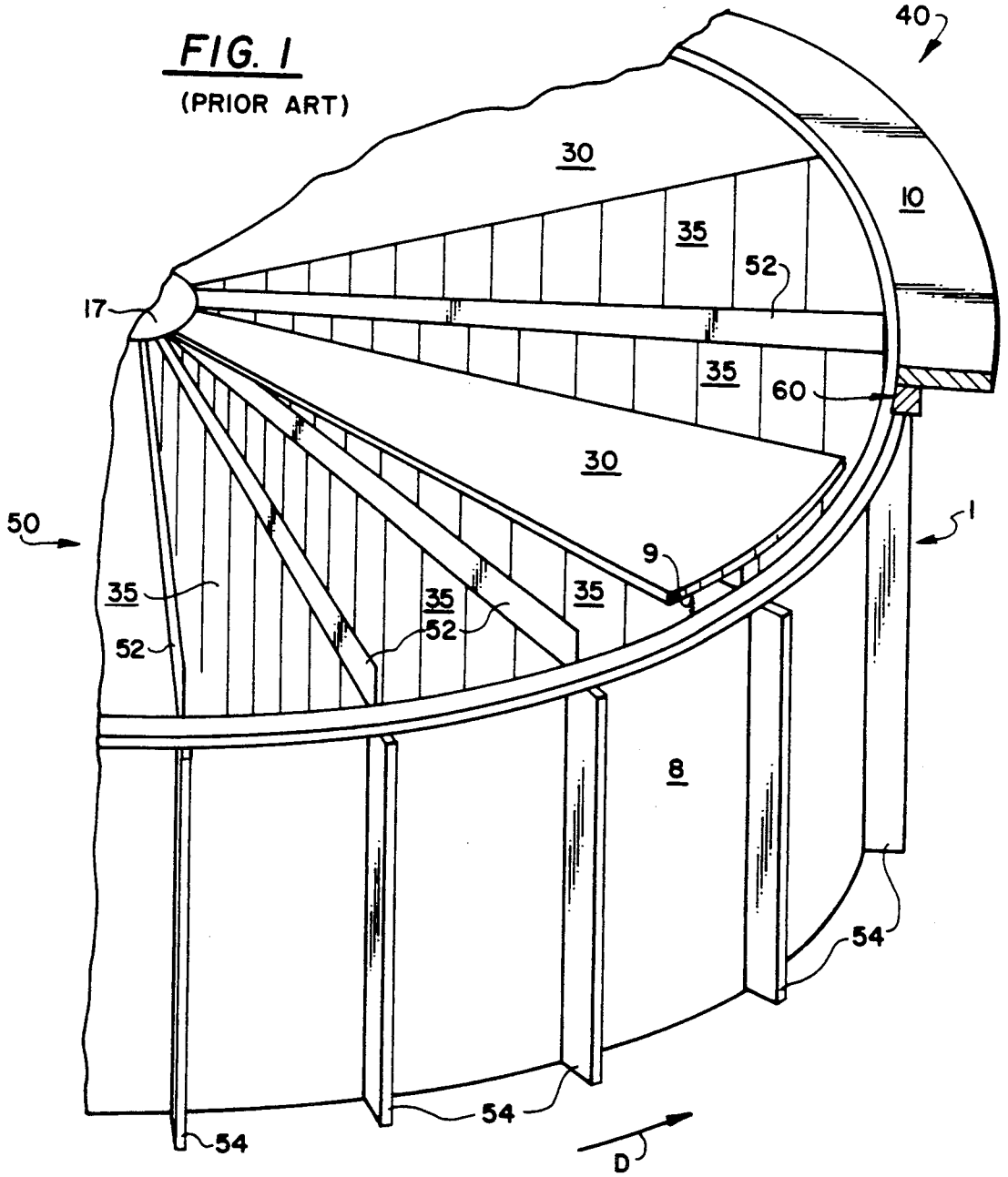
FIG. 1 (PRIOR ART)
FIG. 1 is a cutaway view of a portion of an air heater illustrating a prior art sealing arrangement.
Figure 2:
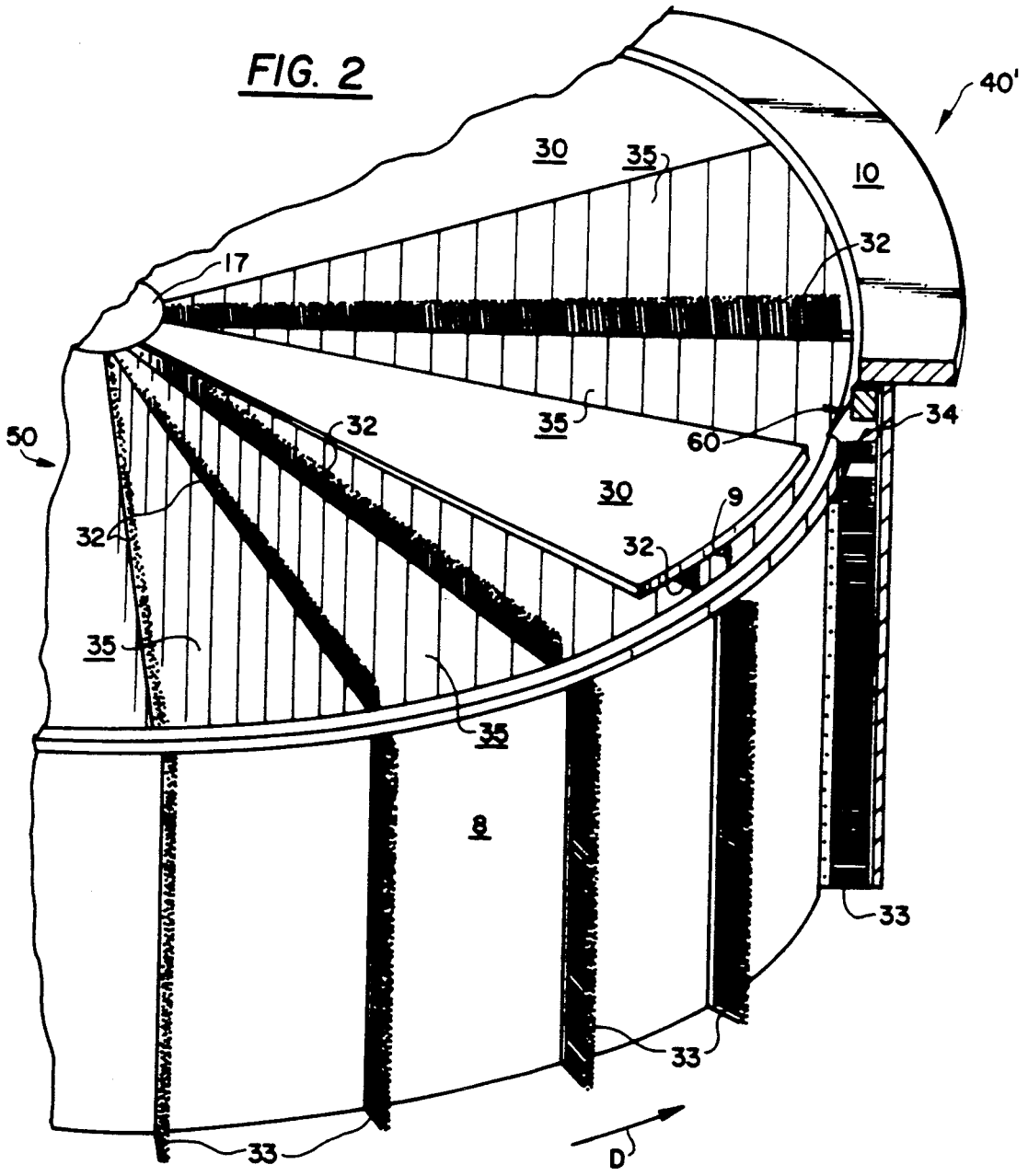
FIG. 2 is a cutaway view of a portion of an air heater showing the rotor and the sealing arrangement of the preferred embodiment.
Figure 3:
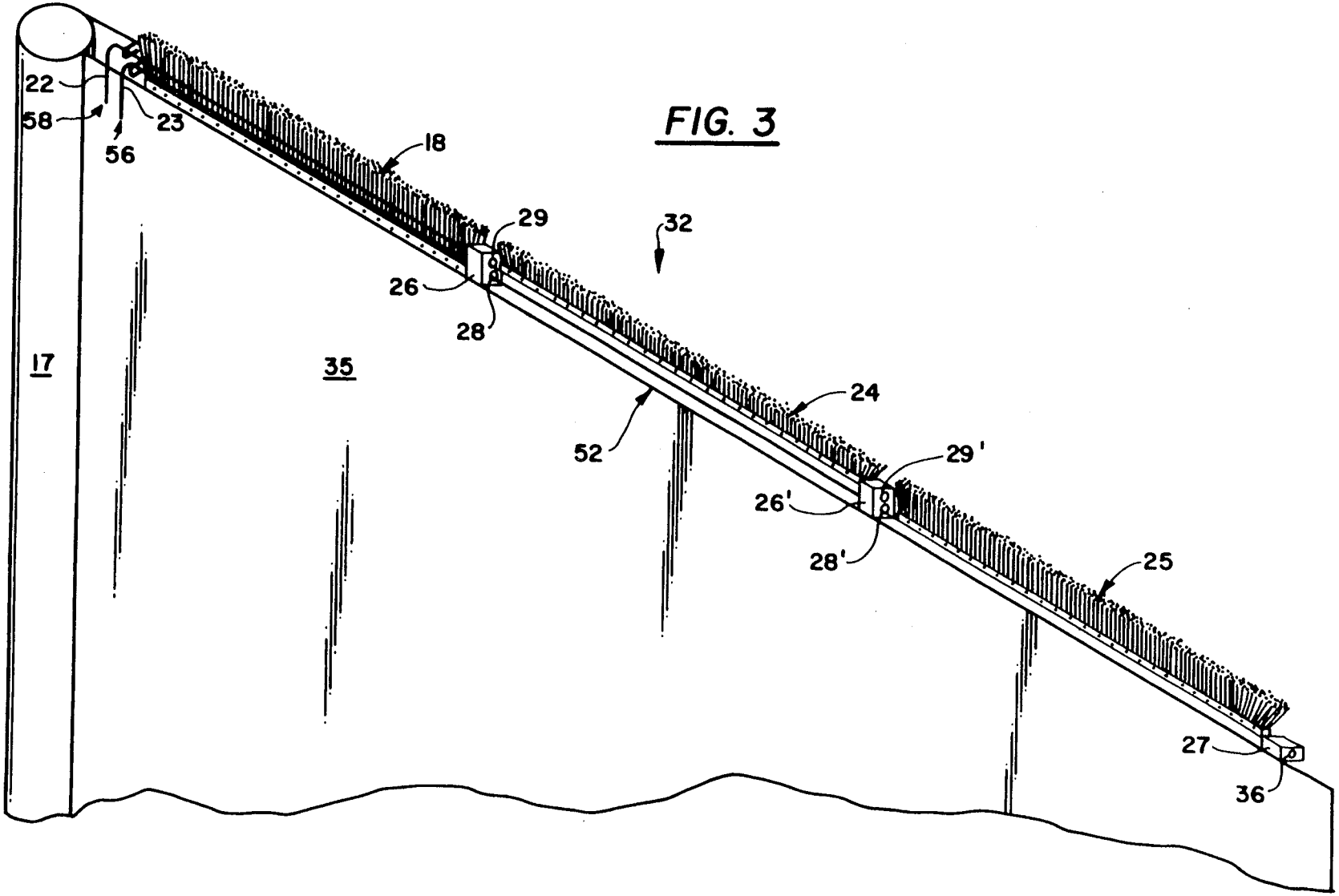
FIG. 3 is one preferred embodiment of the radial seal of the present invention utilizing a dual torsion bar system.

FIG. 2 illustrates a portion of an air heater 40' including rotor 50 and air heater housing 1 with a preferred embodiment of the sealing arrangement of the present invention. Like parts are indicated by the same reference numerals as in FIG. 1. The radial seals 32, the axial seals 33 and the circular seal 34 is also shown (in section). All are attached to the rotor shell 8 or the housing 1 in similar locations to the prior art seals. In operation, the rotor is turning in a direction indicated at D. Connecting flange 10 facilitates connection of air heater 40' the ductwork of a boiler system.

Figure 4A:
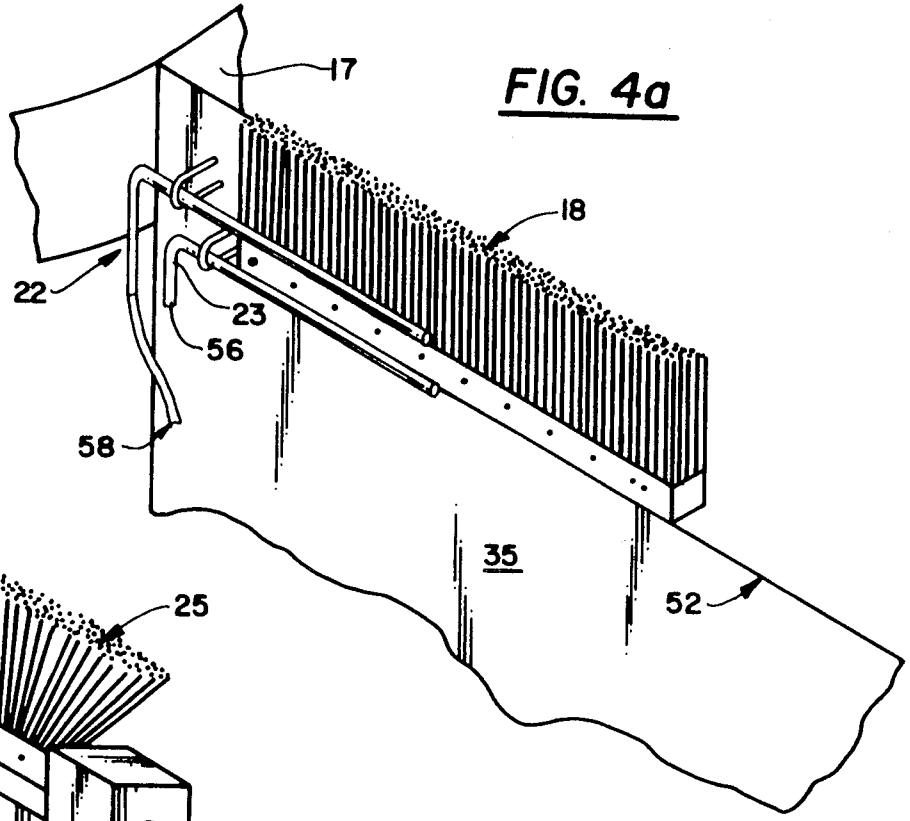
FIG. 4(*a*) is a detail of the portion of the preferred embodiment of FIG. 3 closest to the center of the air heater rotor.
Figure 4B:
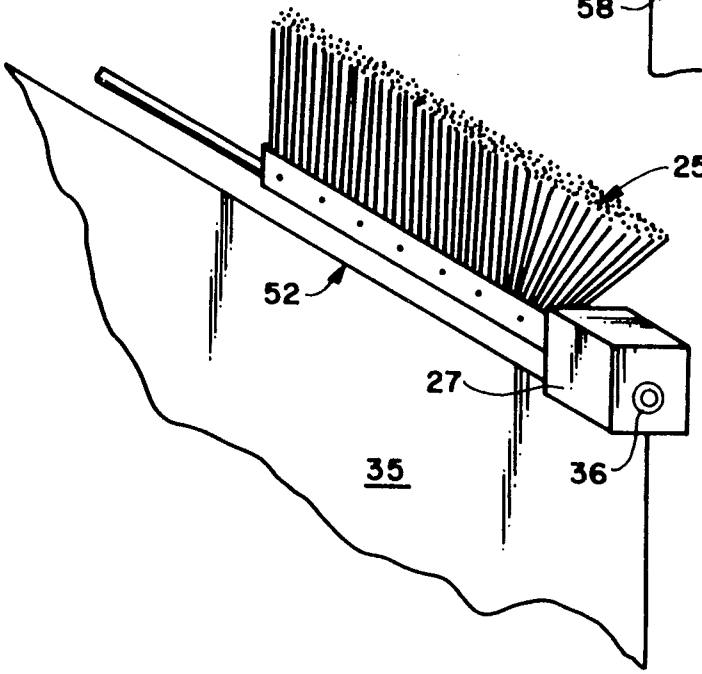

FIGS. 3–6(*a*) illustrate a preferred embodiment of the radial seal of the present invention, designed to prevent convection flow through gap g between the sector plate 30 and the top edge of the dividing plate 35. Two pillow blocks 26 and 26' and an outer pillow block 27 are mounted on the top and bottom radial edge of each divider plate 35 of the rotor 50 (while there is a top and bottom radial seal, they are mirror images of each other and only the top is shown for purposes of simplicity). The purpose of the pillow blocks 26 and 26' and the outer pillow block 27 is to prevent the axial seal 32 from moving axially with respect to the section dividing plate 35 while allowing the axial seal 32 to fold back in response to a change in size of gap g. This is described in greater detail below. The pillow blocks 26 and 26' and outer pillow block 27 are constructed of a wear resistant material with a high maximum temperature rating such as a ceramic material, zirconia or the like. The pillow blocks 26 and 26' each have two cylindrical bearing seats 28 and 29 and 28' and 29' respectively, this is shown in FIG. 4(*b*). The bearing seats 28 and 29 are also made of a wear resistant material with high a temperature rating. The outer pillow block 27 is similar to the pillow blocks but it has only one bearing seat 36. Torsion bars are utilized to allow the radial seals 32 to fold back in response to a varying size in gap g. since torsional rigidity is dependent on the length of the torsional element two torsion bars are utilized in the preferred embodiment, outer seal torsion bar 23 and inner seal torsion bar 22. The use of multiple torsional elements allows the sealing elements to be located at a position remote from the fixed end of each torsional element thus allowing the sealing element to rotate more easily about the axis of the torsional elements. Further the axial seal 32 of the preferred embodiment utilizes three separate flexible brush elements, inner seal brush 18, intermediate seal brush 24 and outer seal brush 25, in order to take advantage of the different torsional characteristics of the inner seal torsion bar 22 and the outer seal torsion bar 23. This will be described in greater detail below.

The outer seal torsion bar 23 is fixed at one end to the dividing plate 35, at a position close to rotor post 17, by a weld or other suitable means of attachment. Torsion bar 23 extends along the top radial edge 52 of the dividing plate 35 through bearing seats 28 and 28' of the pillow blocks 26 and 26' and terminates at the outer edge of the dividing plate 35 in bearing seat 36 of outer pillow block 27. The outer seal brush 25 is attached to the outer seal torsion bar 23 between pillow blocks 26' and 27.

The intermediate seal torsion bar 22 is fixed at one end to the dividing plate 35 by weld or other suitable means at 58 and extends along the top radial edge 54 of the dividing plate 35 through bearing seat 28 of the pillow block 26 and terminates at the bearing seat 28' of pillow block 26'. The intermediate seal brush 24 is attached to the intermediate seal torsion bar 22 between the two pillow blocks 26 and 26'.

Both torsion bars 22 and 23 are fixed at one end with the remainder of each bar being free to rotate in a bearing at the other end. This enables the outer seal brush 25 and the intermediate seal brush 24 to rotate about the axis of the respective torsion bars 23 and 22 due to the relatively low torsional rigidity of the torsion bars 23 and 22. The material and cross sectional size and shape of the torsion bars 23 and 22 are preselected to yield the proper torsional rigidity so as to allow the seal brushes 24 and 25 to "fold back" in response to a force from the sector plate 30 when temperature gradients in the air heater, and other factors, have caused the gap g between the sector plate and the dividing plates to become small. Typically, the intermediate torsion bar 22 is usually selected of a smaller cross section than the outer torsion bar 23 because it is much shorter and torsional deformation is proportional to length in such an arrangement.

The inner seal brush 18 of the preferred embodiment is directly mounted to the top radial edge of dividing plate 35 between rotor post 17 and pillow block 26. The flexibility of the brush itself will adequately compensate for any deformation due to temperature gradients, and other factors, since this deformation is typically of much less magnitude at inner portions of the rotor. However, the inner seal brush 18 could also be mounted on a torsion bar assembly. This assembly would preferably have one end fixed at the outer perimeter of the dividing plate 35 and a rotatable end at the innermost part of the dividing plate 35 in order to allow for adequate torsional deformation of the torsion assembly and movement of the inner seal brush 18.

The rotation of the sealing brushes 24 and 25 about the axis of the torsion bars 22 and 23, respectively, allows the sealing brushes to extend essentially at a right angle to the sector plate 30 when the gap g is large and to "fold back" at a substantial angle to the sector plate when the gap g is small. In all situations the gap is properly sealed. Also, since contact pressure is lessened, the brushes will wear much more slowly than if there was no "fold back" provision. Further, this type of a torsion bar assembly is not prone to failure because of deposits or corrosion because there are essentially no moving parts.

Figures 5A, 5B:
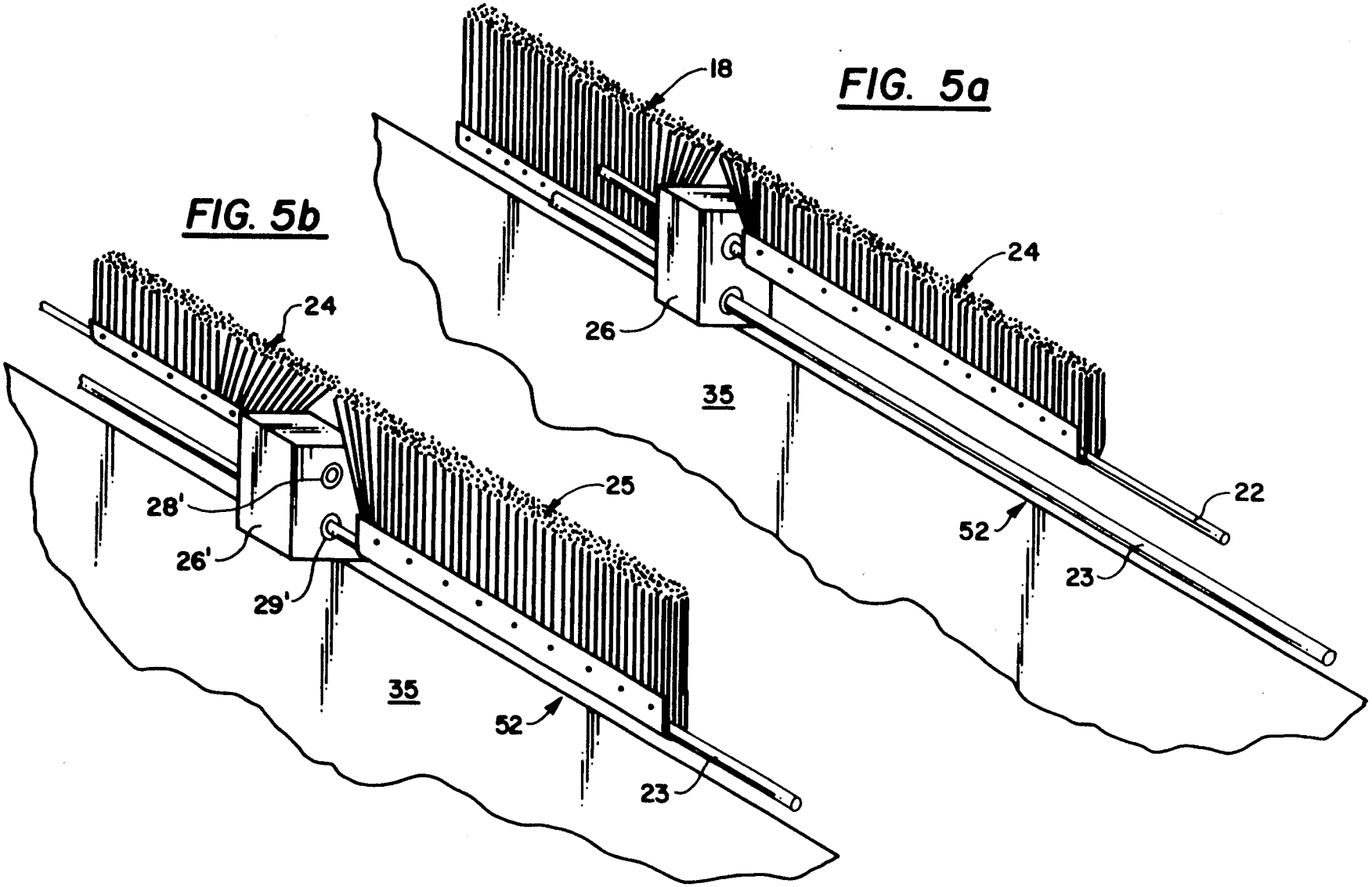
FIG. 5(*a*) is a detail of the portion of the preferred embodiment of FIG. 3 in the proximity of the innermost multiple bearing pillow block.

It is important to note that, in the preferred embodiment, the bristles of brushes 18, 24, and 25 are designed to overlap at pillow blocks 26 and 26'. This is preferable in order to provide a better seal, across gap g, along the entire length of dividing plate 35. In FIGS. 5(*a*) and 5(*b*), The space between brush 24 and the top edge of divider plate 35 is relatively large. This is so for purposes of clarification only, it is preferable to minimize this space in order to limit fluid flow through gap g.

Figures 6A, 6B, 6C, 6D:
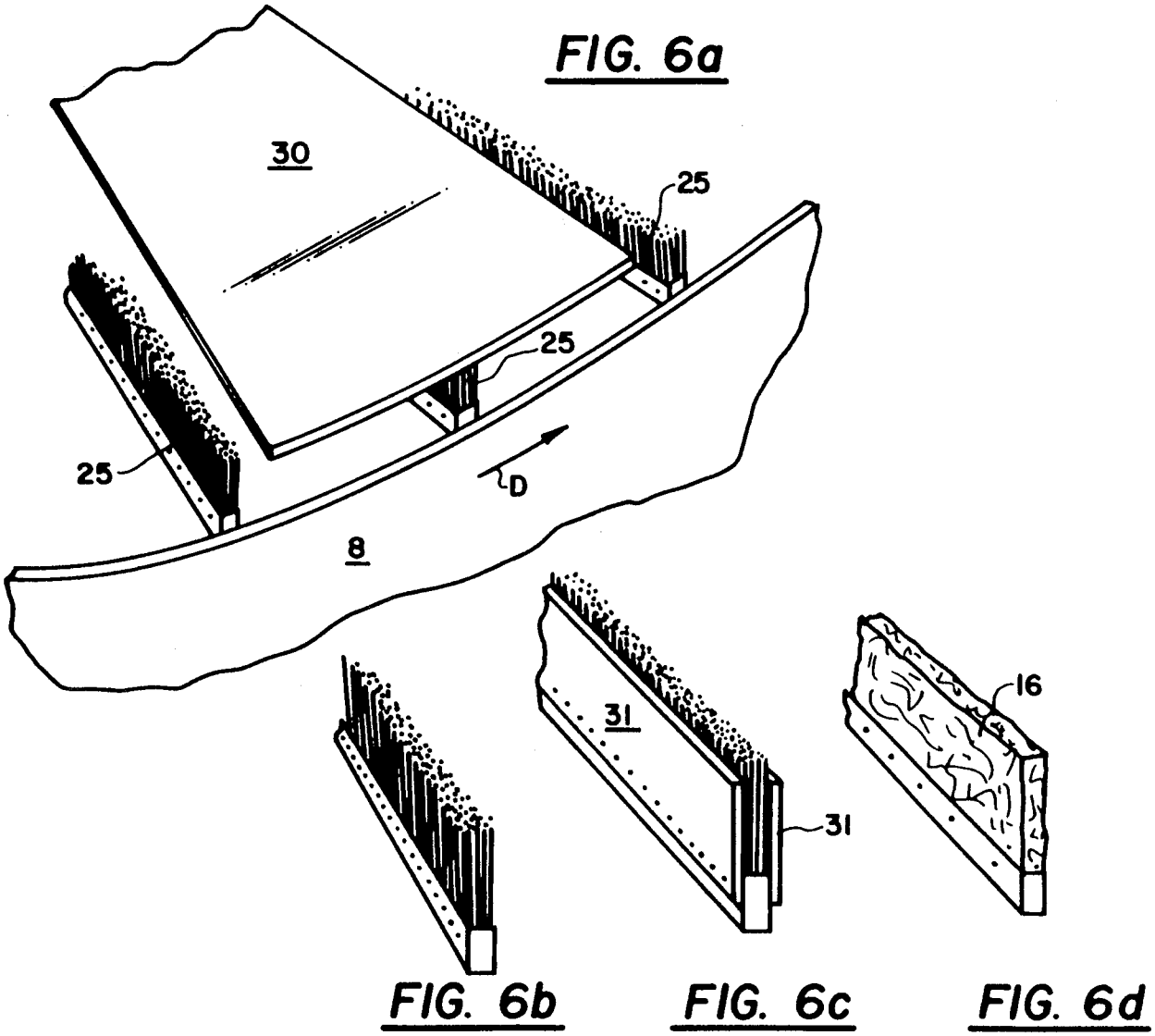
FIG. 6(*a*) is a cutaway view of a section of an air heater rotor showing the radial seal of the preferred embodiment immediately before, during, and immediately after coming into contact with one of the sector plates of an air heater.

While the sealing elements of the preferred embodiment are steel wire brushes, (see FIG. 6(*b*)), they could be brushes comprised of fibers of carbon, ceramic or the like. Or the sealing elements could be made of an amorphic felt or any other flexible material resistant to heat and corrosion (see FIG. 6(*d*)). Further, the sealing elements could be a composite of materials such as in FIG. 5(*c*) where the sealing elements are brushes with metal leaves 31 of a flexible metal or the like on the sides for increased rigidity and sealing capability. In addition, while two torsion bars and three seal elements, are utilized in the preferred embodiment, various combinations of torsional elements and sealing elements may be used depending on system variables and desired response. Further the location and method of attachment of the torsional elements may vary without leaving the scope of the present invention. For example, All three seal brushes 18, 24 and 25 could be mounted to the same torsion assembly, or one long continuous brush could be used, or a plurality of brushes with different lengths could be used. These variables could all be configured so as to provide optimum performance for a particular application. In addition, the material used to construct the torsional elements may vary (e.g. metal, carbon, or the like) as well as the size and shape of the torsional elements. For example, the torsional element may be tapered or have any one of a number cross sectional shapes.

Figure 7A:
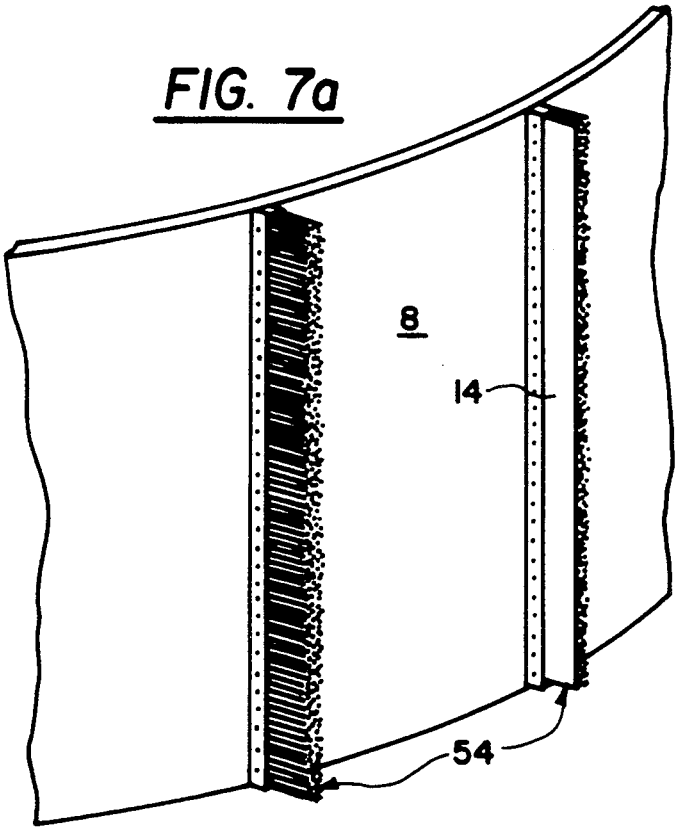
FIG. 7(*a*) is an overview of the axial seal of the preferred embodiment with and without leaf seals.
Figure 7B:
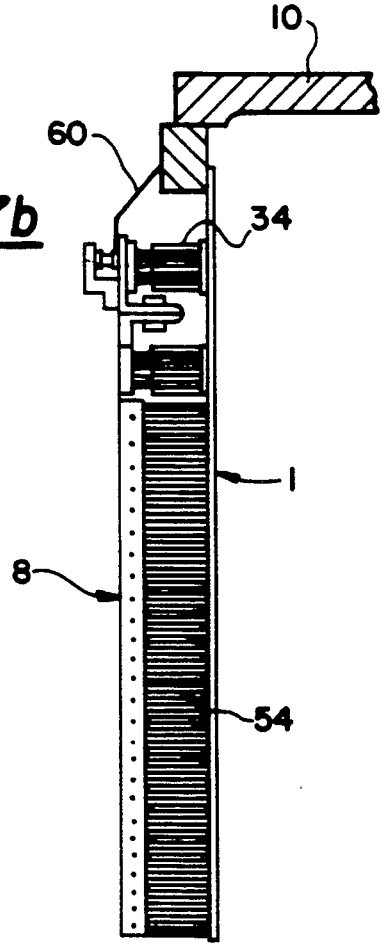

The axial seals 54 of the present invention are shown in FIGS. 7(*a*) and 7(*b*). These axial seals 54 minimize leakage of fluid around the perimeter of the rotor shell 8. In the preferred embodiment, the axial seals 54 are comprised of steel wire brushes affixed to the side of the rotor shall 8 and extend radially to the inside surface of the housing 1 as shown in FIG. 7(*b*). However, these seals could also be constructed of brushes with fibers of carbon, ceramic, or the like or an amorphic felt or other flexible, heat resistant material or the axial seals 54 could include metal leaves 14 provided on one or both sides of the brushes. Further, the axial seals 54 could utilize a torsion bar assembly similar to that of the radial seals of the preferred embodiment described above. Also the axial seals 54 could be attached to housing 1 and extend to the rotor shell 8.

Figure 8:
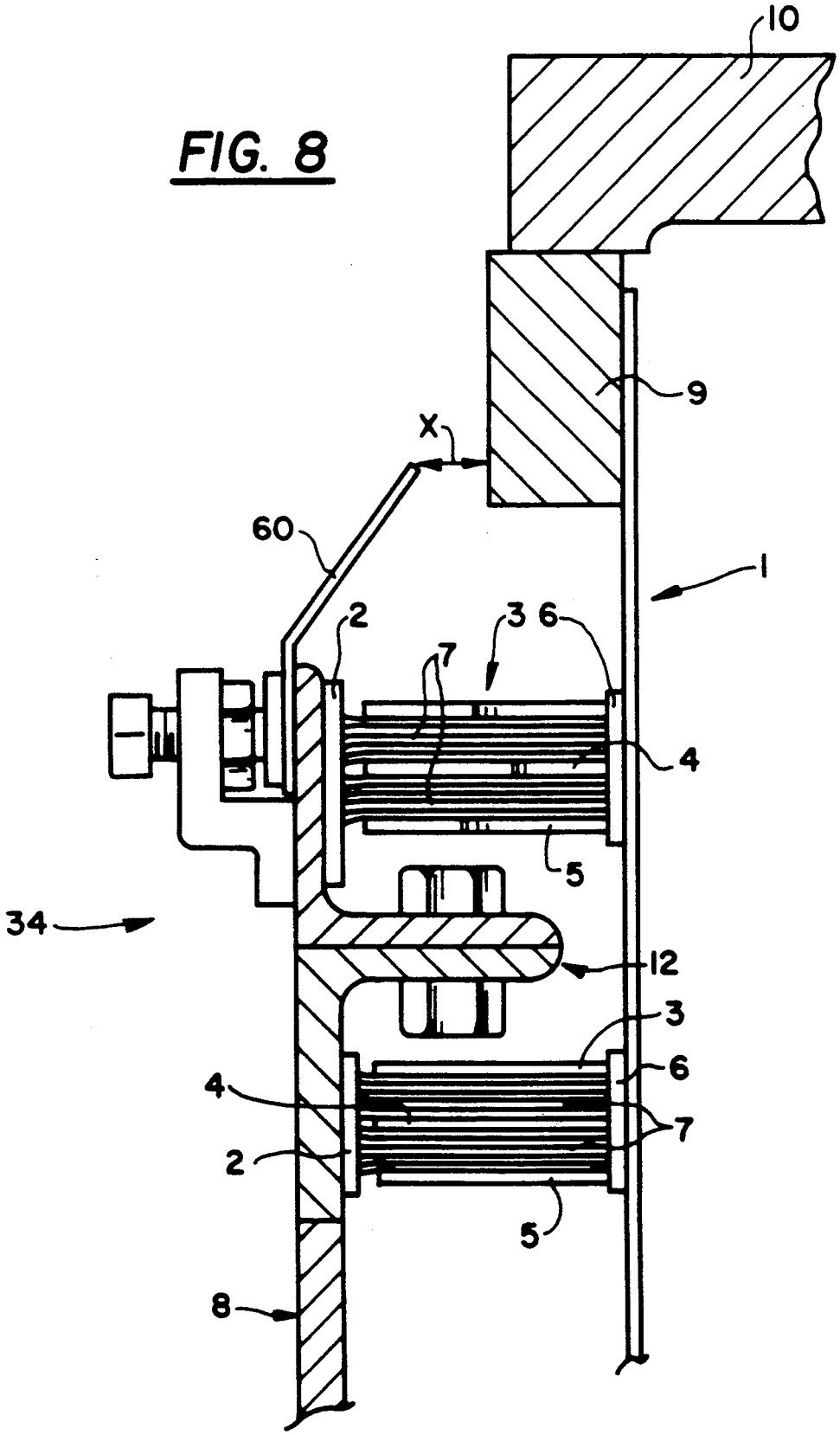
FIG. 8 is a detail of the circular seal of the preferred embodiment of the preferred embodiment in section.
Figure 9:
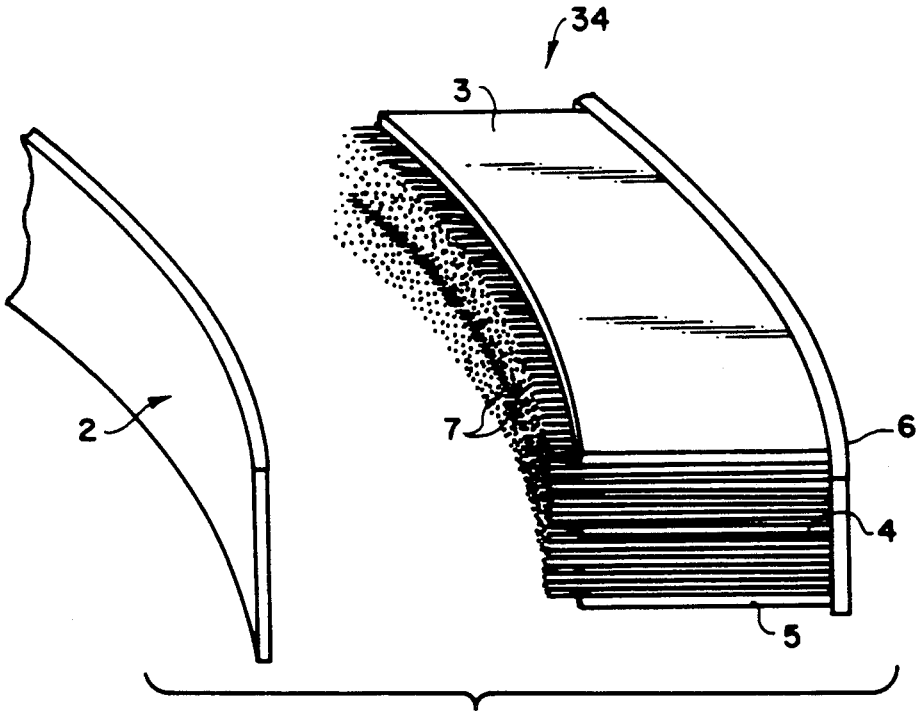
FIG. 9 is an exploded view of a portion of the circular seal of the preferred embodiment.
Figure 10A:
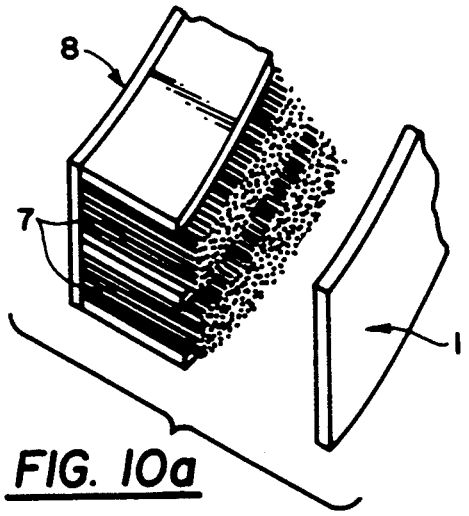
FIGS. 10(*a*) and 10(*b*) are exploded views of the circular seal of the preferred embodiment.
Figure 10B:
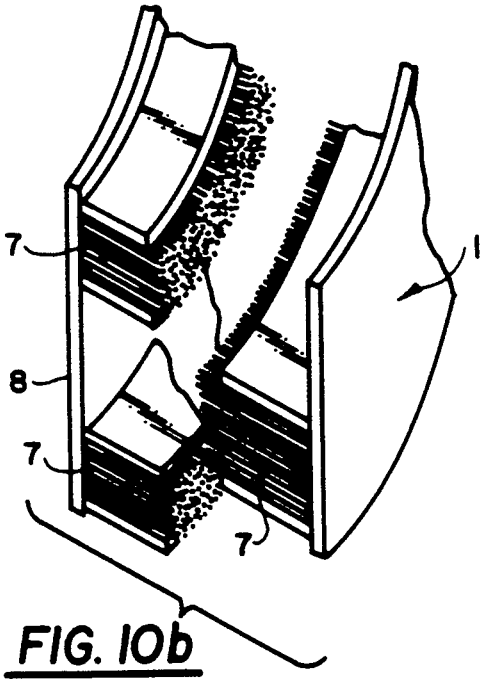

FIGS. 8–10(*b*) illustrate a circular seal 34 of the preferred embodiment. The circular seal 34 extends along the top and bottom circumferential edges of the housing 1 and the rotor 8. Only the top circular seal on the top edge of the housing 1 is illustrated in FIG. 8 for purposes of simplicity. With reference to FIG. 8, the circular seal 34 of the preferred embodiment is composed of four brushes 7 attached to the housing 1 at backplates 6. The brushes 7 are divided into two sets of two. One set of two brushes 7 is located immediately above the flange assembly 12 that holds a prior art seal 60 to the rotor (it may be desirable to leave the prior art seal 60 in place or even attach a wire brush to it, bridging a gap shown at x, for added seal effectiveness). The second set of two brushes 7 is located immediately below the flange assembly 12.

Each set of brushes has an upper seal leaf 3, a middle seal leaf 4, and a lower seal leaf 5. These seal leaves, 3, 4 and 5, are essentially flat rings attached to the housing 1 and extend around the perimeter of housing 1. The combination of the leaves 3, 4 and 5, brushes 7 and the flange assembly 12 create a tortuous path thus restricting any fluid flow that may tend to flow therethrough. A wear plate 2, constructed of a ceramic material or any other abrasion resistant material, is attached to rotor 8 to lessen wear due to the relative motion of the brushes with respect to rotor 8.

The brushes 7 extend substantially further from the housing 1 than the leaves 3, 4 and 5. This allows for a varying distance between the rotor 8 and the housing 1 due to the differential expansion of the rotor as a result of temperature gradients, construction tolerances, sagging due to gravity and other factors. While prior art seals of the type shown at 60 tend to wear unevenly and tear off, they may be left in place and more "loosely" adjusted to avoid these maintenance problems while still providing some additional sealing capability. Alternatively, the existing prior art seal 60 may be retrofitted with an additional brush element (not shown).

While the preferred embodiment of the circular seal has been described many variations are possible. For example, the brushes 7 and leaves 3,4 and 5 could be attached to the rotor shell 8 and the wear plate could be attached to the housing 1 as illustrated in FIG. 10(*a*). Also, as illustrated in FIG. 10 (*b*) varying quantities of brushes 7 and leaves 3,4 and 5 could be utilized and grouped in various combinations with or without a remaining existing seal. Also, brushes 7 could be attached to the rotor shell while the leaves 3, 4 and 5 are attached to the housing 1. Alteratively, brushes 7 could be attached to the housing 1 and leaves 3, 4 and 5 may be attached to the rotor shell. Further, brushes 7 could have bristles comprised of wire, amorphic felt or other temperature resistant manmade material, or bristles of any other flexible, temperature resistant material.

While the invention has been described in connected with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed:

1. A circular seal arrangement for an air heater, comprising:

an air heater housing having substantially a cylindrical shape and an inner circumferential surface;

an air heater rotor contained within said housing, said rotor having substantially a cylindrical shape and an outer circumferential surface, said rotor rotating about a center axis with respect to said housing;

said inner and said outer circumferential surfaces defining a gap therebetween;

said gap varying in size due to differential expansion in said rotor and said housing;

a plurality of flexible sealing elements fixedly attached to said inner circumferential surface and extending around at least a portion of a circumference of said housing;

said sealing elements being in close proximity to each other and defining at least one cavity therebetween;

at least one seal leaf fixedly attached to said inner circumferential surface at a position adjacent each of said sealing elements and extending along at least a portion of said inner circumferential surface;

said sealing elements projecting radially inwardly from said inner circumferential surface a distance at least substantially equal to a maximum distance for said gap;

said at least one seal leaf projecting radially outwardly from said outer circumferential surface, into a corresponding one of said at least one cavity, a distance substantially equal to or less than a minimum distance for said gap;

said combination of said flexible seals and said at least one seal leaf projecting across at least a portion of said gap, providing a tortuous path for fluid flow therethrough; and a wear resistant pad placed opposite said plurality of sealing elements, at a moving interface of said at sealing elements and said outer surface, so as to prevent wear of said outer surface by said flexible sealing elements.

2. A seal arrangement as described in claim 1, wherein said wear resistant pad is constructed of a ceramic material.

3. A seal arrangement as described in claim 1, further comprising:

at least one additional seal leaf fixedly attached to said inner circumferential surface and extending parallel to and immediately adjacent said sealing elements;

said at least one additional seal leaf projecting across a portion of said gap so as to provide added sealing capability to said sealing elements.

4. A seal arrangement as described in claim 1, wherein said flexible sealing elements are at least long enough to project across a maximum size of said gap.

5. A seal arrangement as described in claim 1, wherein said flexible sealing elements are constructed of a wire brush material.

6. A seal arrangement as described in claim 1, wherein said flexible sealing elements are constructed of an amorphic felt material.

7. A circular seal arrangement for an air heater, comprising:

an air heater housing having substantially a cylindrical shape and an inner circumferential surface;

an air heater rotor contained within said housing, said rotor having substantially a cylindrical shape and an outer circumferential surface, said rotor rotating about a center axis with respect to said housing;

said inner and said outer circumferential surfaces defining a gap therebetween;

said gap varying in size due to differential expansion in said rotor and said housing;

at least one flexible sealing element attached to one of said inner circumferential surface and said outer circumferential surface so as to project across said gap a distance of at least substantially equal to a maximum distance for said gap; and a wear resistant pad placed opposite said at least one flexible sealing element and at a moving interface thereon, said wear resistant pad being located on the other of said inner circumferential surface and said outer circumferential surface so as to prevent wear of the same by said at least one flexible sealing element.

8. A seal arrangement as described in claim 7, wherein said wear resistant pad is constructed of a ceramic material.

9. A seal arrangement as described in claim 7, further comprising:

at least one elongated leaf fixedly attached to said seal element and extending parallel to and immediately adjacent said sealing element;

said elongated leaf projecting across a part of said remaining portion of said gap.

10. A seal arrangement as described in claim 7, wherein said seal element is constructed of a wire brush material.

11. A seal arrangement a described in claim 7, wherein said seal element is constructed of an amorphic felt material.

* * * * *